United States Patent [19]

Battisti

[11] 4,087,283

[45] May 2, 1978

[54] COMPOSITION FOR HARDENING PHOTOGRAPHIC HYDROPHILIC BINDER AND PHOTOGRAPHIC ELEMENT CONTAINING THE SAME

[75] Inventor: Angelo J. Battisti, Windsor, N.Y.

[73] Assignee: GAF Corporation, Wayne, N.J.

[21] Appl. No.: 662,939

[22] Filed: Mar. 1, 1976

[51] Int. Cl.[2] ..... G03C 1/30; G03C 1/40

[52] U.S. Cl. ..... 96/111; 96/100 R; 96/76 R; 96/77; 252/182; 106/125; 260/112 R; 260/117

[58] Field of Search ..... 96/111, 100, 67, 77; 260/112 R, 117, 112.5; 427/338; 106/125; 252/182; 526/317

[56] References Cited

U.S. PATENT DOCUMENTS 3,098,693 7/1963 Sheehan et al. ..... 96/111

3,795,666 3/1974 Konig et al. ..... 260/112.5

OTHER PUBLICATIONS

Oftedahl, Abstract of Serial No. 801,772, filed Feb. 24, 1969.

*Primary Examiner*—Won H. Louie, Jr.
*Attorney, Agent, or Firm*—Walter C. Kehm; Edward G. Comrie

[57] ABSTRACT

A hardener composition for hardening a hydrophilic photographic binder comprises a carbodiimide hardening agent and from about 5 to about 200 mol per cent, based on the carbodiimide hardening agent, of an N-hydroxy cyclic amine having a hydroxy group on the ring amino nitrogen atom. The layers to be hardened are exemplified by photographic gelatino silver halide layers and/or the gelatino protective layer of a photographic element.

5 Claims, No Drawings

COMPOSITION FOR HARDENING PHOTOGRAPHIC HYDROPHILIC BINDER AND PHOTOGRAPHIC ELEMENT CONTAINING THE SAME

The present invention relates to a hardener for a photographic layer containing a hydrophilic binder, and more particularly to the joint use of a carbodiimide hardening agent and an N-hydroxy cyclic amine to harden gelatin.

Gelatin is in widespread use as a binder for photographic layers, and gelatin hardeners are customarily employed to reduce the softening and swelling of gelatin in water and to increase its resistance to scratching. A useful class of gelatin hardeners are the carbodiimides, which are disclosed as hardening a variety of photographic gelatin layers. However, carbodiimide gelatin hardeners are expensive, and hence means have been sought to improve the efficiency of carbodiimide gelatin hardeners to obtain a greater hardening effect at lower levels of hardener.

It is thus an object of the present invention to improve the effectiveness of carbodiimide hardeners at low concentrations.

This and other objects are fulfilled by the present invention, which provides a hardener composition for hardening a hydrophilic photographic binder, comprising a carbodiimide hardening agent and from about 5 to about 200 mol percent, based on the carbodiimide hardening agent, of an N-hydroxy cyclic amine.

N-hydroxy cyclic amines have been previously proposed for use with carbodiimides to prevent racemization during synthesis of peptides using a carbodiimide as the condensing agent. See, e.g. Konig et al U.S. Pat. No. 3,795,666 and the prior art cited therein, as well as *J. Amer. Chem. Soc.*, 86, 1839 (1964) and "Reagents For Organic Synthesis", L. F. and M. Feiser, Volume I, p. 485–487 (1967) and Volume III, p. 156 (1972). Of course, racemization plays no role in gelatin hardening. Furthermore, the N-hydroxy cyclic amines, by themselves, do not exhibit any gelatin hardening effect. Hence it was entirely unexpected that the N-hydroxy cyclic amines would act to improve the effectiveness of the carbodiimide hardening agent. By the use of the present invention, the effectiveness of a given concentration of the carbodiimide hardening agent is increased by the addition of the N-hydroxy cyclic amine, or a smaller amount of carbodiimide hardening agent can be used with the N-hydroxy cyclic amine to give the same effect as a larger amount of carbodiimide alone.

The N-hydroxy cyclic amine may be any saturated or unsaturated cyclic amine having a hydroxy group on the ring amino nitrogen. The N-hydroxy cyclic amine may be mono- or bicyclic, and the ring or rings may be aliphatic or aromatic and they may contain only carbon atoms in addition to the ring amino nitrogen or there may be one or two hetero atoms in one or both rings selected from the group consisting of oxygen, sulfur and nitrogen atoms. Typical examples of useful N-hydroxy cyclic amines are dicarboxylic cyclic imides of the formula:

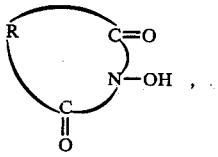

where R is divalent aliphatic of 1 to 6 carbon atoms or arylene, preferably phenylene, such as N-hydroxy succinimide and N-hydroxyphthalimide; cycloaliphatic amines of the formula:

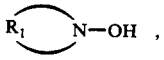

where $R_1$ is divalent aliphatic of 2 to 8 carbon atoms, such as N-hydroxypiperidine; and saturated or unsaturated heterocyclic amines of the formula:

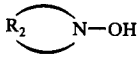

where $R_2$ represents the necessary atoms to form a mono- or bicyclic heterocyclic ring structure with the nitrogen atom to which it is attached, said heterocyclic structure containing one or two hetero atoms selected from the group consisting of oxygen, sulfur and nitrogen such as 3-hydroxy-4-oxo-3,4-dihydro-1,2,3-benzotriazole and 1-hydroxybenzotriazole.

Any carbodiimide hardening agent can be employed in the practice of this invention. Suitable carbodiimides are described in Sheehan U.S. Pat. Nos. 2,938,892, issued May 31, 1960, and 3,135,748, issued June 2, 1964; East German Pat. No. 7218, issued May 10, 1954; Coles and Levine U.S. Pat. No. 3,100,704, issued Aug. 13, 1963; and Canadian Pat. No. 668,628, issued Aug. 13, 1963. Typical carbodiimides can be described by the formula R—N=C=N—R'. Examples of R and R' include monovalent organic radicals such as alkyl, alkoxy, allyl, aryl and heterocyclic groups, preferably of 1 to 20 carbon atoms. Typical examples are 1,3-dimethylcarbodiimide, 1-methyl-3-methoxymethylcarbodiimide, di-isopropylcarbodiimide, dicyclohexylcarbodiimide, 1-ethyl-3-[2-morpholinyl-(4)-ethyl] carbodiimide, 1-cyclohexyl-3-[2-morpholinyl-(4)-ethyl] carbodiimide, 1-ethyl-3-(3-dimethylaminopropyl)-carbodiimide, 1-n-butyl-3-[(3-dimethylamino)propyl]-carbodiimide, and the like, and acid salts or quaternary amine salts thereof. The preparation of suitable carbodiimide hardening agents are described in U.S. Pat. No. 3,135,748, U.S. Pat. No. 2,938,892, U.S. Pat. No. 3,236,882 and East German Pat. No. 7218.

The hardener composition of this invention may be incorporated with any hardenable layer of a photographic element. The hardenable material in the hardenable layer can be entirely of a proteinaceous nature, such as gelatin, gelatin derivatives and the like or it can contain in addition to gelatin, in any proportions, some other polymeric material, such as a vinyl polymer, e.g. polyvinyl alcohol, or an acrylic polymer, e.g. ethyl acrylate-acrylic acid copolymer, butyl acrylate-acrylic acid copolymer, or a mixture thereof. The hardener composition employed in this invention is effective in hardening polymers having hydrophilic groups, e.g. hydroxyl, carboxyl, etc. Thus, these hardeners are useful in compositions in which the hardenable binder or colloid is entirely a synthetic or natural material.

The hardening composition of the invention may be incorporated into the hydrophilic binder composition during coating of the layer to be hardened. Since the hardening composition is fast acting, it is preferred to add the hardening composition to the hydrophilic binder composition substantially immediately before coating, such as by admixing a "sidestream" containing the hardening composition with the coating solution. When sidestream addition is employed, better results are obtained if the carbodiimide and the N-hydroxy cyclic amine are added separately, e.g. by using two sidestreams or by including the N-hydroxy cyclic amine in the coating solution and adding the carbodiimide as a sidestream. Aqueous or alcoholic solutions of the carbodiimide hardening agent are satisfactory means of adding the carbodiimide hardening agent to the solution containing the hydrophilic binder and aqueous and/or alcoholic solutions of the N-hydroxy cyclic amine are likewise suitable. Alternatively, the carbodiimide hardening agent may be coated with one hydrophilic binder layer and the N-hydroxy cyclic amine coated with an adjacent hydrophilic binder layer, since the hardening composition is effective under such conditions to harden the composite product. Another alternative procecedure is to treat the already coated layer or layers containing the hydrophilic binder with a solution containing the carbodiimide hardening agent and the N-hydroxy cyclic amine by coating, spraying or immersing, etc., in the dark.

Optimum amounts of the carbodiimide hardening agent and N-hydroxy cyclic amine will be determined empirically. Good results may be obtained with an amount of carbodiimide hardening agent of from about 0.01 to about 2.0 mmole, preferably from about 0.01 to about 1.0 mmole, of carbodiimide hardening agent per gram of hydrophilic binder and from about 5 to about 200 mol percent, preferably about 20 to about 125 mol percent, based on the carbodiimide hardening agent, of the N-hydroxy cyclic amine.

Advantageously, the hardener composition may be used to harden a layer of the photographic element containing a silver halide emulsion in a hydrophilic binder, e.g. gelatin, and various additives used in photographic emulsions, such as plasticizers, coating aids, anti-foggants, speed-increasing compounds, such as quaternary ammonium compounds, polyethylene glycols or thioethers, spectral sensitizers, sensitizing dyes, and developing agents, As is known, the silver halide may be silver bromide, silver chloride, silver chlorobromide, silver bromoiodide or silver chloro-bromo iodide. The silver halides used can be those which form latent images predominantly on the surface of the silver halide grains or those which form latent images inside the silver halide grains, or mixtures thereof. The silver halide emulsions may be of the negative or of the direct positive type. The present invention finds particular utility in hardening an X-ray film product or a color photographic element, i.e. one containing a color-forming compound, such as color couplers, dye-releasing couplers and the like.

The present invention is illustrated by the following Examples. In the specification and in the appended claims, all parts and proportions are by weight, unless otherwise noted.

In the Examples, the percent swell was determined using the procedure described by Flynn and Levine; Photo. Sci. Eng., Vol. 8, No. 5, p. 275–281 (1964). WSR (wet scratch resistance) values were determined by running a weighted stylus of a specified diameter across the hardened coating after immersion in water. The weight in grams required to break through the emulsion is the value for WSR reported in the Examples; therefore, a higher value represents a harder coating.

EXAMPLE 1

To a 6% aqueous solution of gelatin at 38° C containing 5 ml of a 9.1% solution of saponin per liter, was added the N-hydroxy cyclic amine in the amounts shown below, as a freshly prepared 5% solution in methanol. The carbodiimide, also as a freshly prepared 5% solution in methanol, was added in the concentrations shown in Table I immediately before coating on film base. The coatings were stored for 3 days at 23° C and 50% R.H. and then the wet scratch resistance (WSR) and percent swell were determined.

The results are as follows:

Table I

| Run | Carbodiimide Hardening Agent[1] (mmole/g gelatin) | N-hydroxy Cyclic Amine[2] (mmole/g gelatin) | Swell (%) | WSR[3] (grams) |
|---|---|---|---|---|
| 1 | 0.4 | 0 | 380 | 53 |
| 2 | 0.2 | 0 | 560 | 35 |
| 3 | 0.2 | 0.02 | 430 | 53 |
| 4 | 0.2 | 0.05 | 380 | 60 |
| 5 | 0.2 | 0.10 | 300 | 62 |
| 6 | 0.2 | 0.15 | 340 | 59 |
| 7 | 0.2 | 0.20 | 290 | 60 |
| 8 | 0.2 | 0.30 | 340 | 56 |

[1]1-Ethyl-3-[3-(dimethylamino)propyl] carbodiimide, hydrochloride
[2]N-Hydroxysuccinimide
[3]15 mil. stylus

EXAMPLE 2

The same procedure was followed as for Example 1, except for the N-hydroxy cyclic amine used. The results are given in Table II.

Table II

| Run | Carbodiimide Hardening Agent[1] (mmole/g gelatin) | N-hydroxy Cyclic Amine[2] (mmole/g gelatin) | WSR[3] (grams) | Swell (%) |
|---|---|---|---|---|
| 1 | 0.2 | — | 42 | 454 |
| 2 | 0.2 | 0.02 | 45 | 374 |
| 3 | 0.2 | 0.05 | 47 | 312 |
| 4 | 0.2 | 0.01 | 45 | 360 |
| 5 | 0.2 | 0.15 | 36.5 | 390 |
| 6 | 0.2 | 0.3 | 39 | 362 |

[1]1-Ethyl-3-[3-(dimethylamino)propyl] carbodiimide, hydrochloride
[2]N-Hydroxybenzotriazole monohydrate
[3]15 mil stylus

EXAMPLE 3

The procedure of Example 1 was followed, except for the N-hydroxy cyclic amine used. The results are given in Table III.

Table III

| Run | Carbodiimide Hardening Agent[1] (mmole/g gelatin) | N-hydroxy Cyclic Amine[2] (mmole/g gelatin) | WSR[3] (grams) | Swell (%) |
|---|---|---|---|---|
| 1 | 0.2 | — | 35 | 431 |
| 2 | 0.2 | 0.05 | 45 | 320 |
| 3 | 0.2 | 0.1 | 55 | 244 |
| 4 | 0.2 | 0.2 | 27 | 365 |
| 5 | 0.2 | 0.3 | 11 | 388 |

[1]1-Ethyl-3-[3-(dimethylamino)propyl] carbodiimide, hydrochloride
[2]N-hydroxypiperidine
[3]15 mil stylus

EXAMPLE 4

The procedure of Example 1 was followed, except for the carbodiimide hardener used. The results are given in Table IV.

Table IV

| Run | Carbodiimide Hardening Agent[1] (mmole/g gelatin) | N-hydroxy Cyclic Amine[2] (mmole/g gelatin) | WSR[3] (grams) | Swell (%) |
|---|---|---|---|---|
| 1 | 0.2 | — | 40 | 329 |
| 2 | 0.2 | 0.02 | 50 | 262 |
| 3 | 0.2 | 0.05 | 50 | 187 |
| 4 | 0.2 | 0.1 | 53 | 208 |
| 5 | 0.2 | 0.2 | 54 | 205 |
| 6 | 0.2 | 0.3 | 50 | 255 |

[1]1-n-Butyl-3-[(dimethylamino)propyl]-carbodiimide hydrochloride
[2]N-hydroxysuccinimide
[3]15 mil stylus

EXAMPLE 5

The same procedure was followed as for Example 1, except for the carbodiimide hardener used. The results are given in Table V.

Table V

| Run | Carbodiimide Hardening Agent[1] (mmole/g Gelatin) | N-hydroxy Cyclic Amine[2] (mmole/g Gelatin) | WSR[3] (grams) | Swell (%) |
|---|---|---|---|---|
| 1 | 0.05 | — | 10 | 626 |
| 2 | 0.1 | — | 25 | 662 |
| 3 | 0.2 | — | 33 | 559 |
| 4 | 0.3 | — | 40 | 490 |
| 5 | 0.4 | — | 36 | 368 |
| 6 | 0.02 | 0.2 | 53 | 362 |
| 7 | 0.2 | 0.05 | 45 | 522 |
| 8 | 0.2 | 0.1 | 57 | 381 |
| 9 | 0.2 | 0.15 | 46 | 324 |
| 10 | 0.2 | 0.2 | 45 | 543 |

[1]1-Cyclohexyl-3-[2-morpholinyl-(4)-ethyl] carbodiimidemetho-p-toluene sulfonate
[2]N-Hydroxysuccinimide
[3]15 mil stylus In each of Examples 1–5, the addition of a small amount of N-hydroxyamine increases the effectiveness of the carbodiimide hardener. These Examples show that, in general, the improvement in the action of the carbodiimide increases as the ratio of N-hydroxyamine to carbodiimide increases, and then is maximized at a certain ratio of N-hydroxyamine to carbodiimide, after which the effectiveness of the N-hydroxyamine is reduced.

EXAMPLE 6

A fine-grain gelatino silver chlorobromide emulsion was prepared and coated on a polyester support at a coating weight of 229 mg silver/sq. ft. and 241 mg gelatin/sq. ft. The emulsion contained a magenta color former (8% 1-(2,4,6-trichlorophenyl)-3-(3-[α-(2,4-di-tert-amyl-phenoxy)acetamido]-benzamido)5-pyrazolone dispersed in tricresyl phosphate). A carbodiimide hardening agent and/or an N-hydroxy cyclic amine were added to the emulsion immediately before coating with the results reported in Table VI below. The melting point, WSR and Swell were measured 24 hours after coating.

Table VI

| Run | Carbodiimide Hardening Agent[1] (mmole/g gelatin) | N-Hydroxy Cyclic Amine[2] (mmole/g gelatin) | MP (° C) | WSRT[3] (grams) | Swell (%) |
|---|---|---|---|---|---|
| 1 | 0.25 | 0 | 53 | 1 | >1000 |
| 2 | 0 | 0.25 | 31 | 0 | >1000 |
| 3 | 0.25 | 0.25 | 90+ | 1 | 217 |

Table VI-continued

| Run | Carbodiimide Hardening Agent[1] (mmole/g gelatin) | N-Hydroxy Cyclic Amine[2] (mmole/g gelatin) | MP (° C) | WSRT[3] (grams) | Swell (%) |
|---|---|---|---|---|---|
| 4 | 0.4 | 0 | 90+ | 12 | 114 |

[1]1-Ethyl-3-(3-dimethylaminoprpyl)-carbodiimide hydrochloride
[2]N-Hydroxysuccinimide
[3]15 mil stylus Runs 1 and 2 show that at a level of 0.25 mmole/gram of gelatin, neither the carbodiimide alone nor the N-hydroxy cyclic amine alone achieved any hardening of the gelatin. Run 3 shows that the use of the N-hydroxy cyclic amine with the carbodiimide gives a hardening equivalent to the carbodiimide at almost twice the concentration in Run 4.

EXAMPLE 7

The procedure of Example 6 was followed, except that the gelatino silver chlorobromide emulsion contained 10% by weight of 60:40 copolymer of ethyl acrylate and acrylic acid, based on the total weight of gelatin and copolymer. The results are shown in Table VII below. The time the data were obtained is noted in the Table.

Table VII

| Carbodiimide Hardening Agent (mmole/g[1] binder) | N-Hydroxy Cyclic Amine (mmole/g[1] binder) | >24 hrs. MP (° C | 24 hrs. WSR[2] (grams) | 24 hrs. Swell (%) |
|---|---|---|---|---|
| 0.30 | 0 | >95 | 18.0 | 323 |
| 0.20 | 0.10 | >95 | 17.5 | 177 |

[1]Based on total weight of gelatin and copolymer
[2]15 mil stylus

This shows that the hardening effect of the composition of the invention is observed when a synthetic polymer replaces part of the gelatin.

EXAMPLE 8

A medical X-ray film was prepared by coating a gelatino silver bromoiodide emulsion on a support at a coating weight of 400 mg/sq. ft. of silver and 280 mg/sq. ft. of gelatin. This layer was overcoated with a protective gelatin layer containing 1-ethyl-3-(diethylaminopropyl)-carbodiimide hydrochloride hardening agent, which was added to the coating solution as a sidestream just before coating.

A series of tests were carried out in which the same amount of N-hydroxy succinimide was added to the protective layer coating solution, together with varied amounts of the carbodiimide, with the results reported in Table VIII below. The data were obtained 24 hours after coating.

Table VIII

| Carbodiimide Hardening Agent (mmole/g gelatin)[1] | N-Hydroxy Cyclic Amine (mmole/g gelatin)[1] | WSR[2] (g) |
|---|---|---|
| 0.21 | 0 | 6 |
| 0.42 | 0 | 10 |
| 0.63 | 0 | 18 |
| 0.84 | 0 | 55 |
| 0.21 | 0.2 | 50 |
| 0.42 | 0.2 | 86 |
| 0.63 | 0.2 | 108 |

Table VIII-continued

| Carbodiimide Hardening Agent (mmole/g gelatin)[1] | N-Hydroxy Cyclic Amine (mmole/g gelatin)[1] | WSR[2] (g) |
|---|---|---|
| 0.84 | 0.2 | 144 |

[1]Based on gelatin in protective layer only
[2]Using a 45 mm stylus; data are for the combined protective gelatin layer and emulsion layer.

These data show the large improvement in hardening effect of the carbodiimide brought about by the N-hydroxy cyclic amine.

A second series of tests were carried out in which an equimolar amount of N-hydroxy succinimide, based on the carbodiimide, was added to the coating solution for the silver halide emulsion layer or the coating solution for the protective layer, or to both. The results are reported in Table IX below. The amount of both agents were calculated on the basis of the total gelatin in both layers, not just on the gelatin in the protective layers as in Table VIII. The data were obtained 24 hours after coating.

Table IX

| | WSR[1] OF PRODUCT WHERE N-HYDROXY CYCLIC AMINE WAS ADDED TO | | |
|---|---|---|---|
| Carbodiimide Hardening Agent[2] (mmole/g gelatin) | Surface Layer (g) | Emulsion Lyaer (g) | Surface and Emulsion Layers (g) |
| 0.10 | 80 | 140 | 140 |
| 0.15 | 98 | 164 | 164 |
| 0.20 | 102 | — | 195 |
| 0.25 | 195 | 195 | 195 |
| 0.30 | — | — | 195 |

[1]Using 45 mm stylus; data are for the combined protective gelatin layer and emulsion layer.
[2]Based on total gelatin in both layers.

These data show that at low levels of carbodiimide, the most effective hardening is obtained when the N-hydroxy cyclic amine is in both the protective layer and the emulsion layer, but that at higher levels, the N-hydroxy cyclic amine can be in either or both layers with about the same effect.

What is claimed is:

1. A photographic element comprising at least one supported layer of a photographic silver halide emulsion in a hydrophilic binder effectively hardened by a hardener composition comprising a carbodiimide hardening agent selected from the group consisting of 1,3-dimethyl-carbodiimide, 1-methyl-3-methoxy-methyl-carbodiimide, di-isopropyl carbodiimide, dicyclohexyl-carbodiimide, 1-ethyl-3-[2-morpholinyl-(4)-ethyl]-carbodiimide, 1-cyclohexyl-3-[2-morpholinyl-(4)-ethyl]-carbodiimide, 1-ethyl-3-(3-dimethylaminopropyl)-carbodiimide, 1-n-butyl-3-[(3-dimethylamino)propyl]-carbodiimide, and acid or quaternary amine salts thereof, and an N-hydroxy cyclic amine selected from the group consisting of N-hydroxy succinimide, N-hydroxyphthalimide, N-hydroxypiperidine, 3-hydroxy-4-oxo-3,4-dihydro-1,2,3-benzotriazole and 1-hydroxybenzotriazole.

2. The photographic element according to claim 2, which is a color photographic element containing a color coupler.

3. A photographic element as set forth in claim 2 wherein the carbodiimide hardening agent is present in an amount of from 0.01 to about 2.0 m mole per gram of hydrophilic binder and from about 5 to 200 mole percent, based on the carbodiimide hardening agent of the N-hydroxy cyclic amine.

4. A photographic element as set forth in claim 2 wherein the carbodiimide hardening agent is present in an amount of from 0.01 to about 1.0 m mole per gram of hydrophilic binder and from about 20 to 125 mole percent, based on the carbodiimide hardening agent of the N-hydroxy cyclic amine.

* * * * *